US009828566B2

(12) United States Patent
Anderson et al.

(10) Patent No.: US 9,828,566 B2
(45) Date of Patent: Nov. 28, 2017

(54) BORON FREE CORROSION INHIBITORS FOR METALWORKING FLUIDS

(71) Applicant: Afton Chemical Corporation, Richmond, VA (US)

(72) Inventors: Steven Anderson, Church Lawton (GB); Carl Williams, Newcastle Under Lyme (GB)

(73) Assignee: AFTON CHECMICAL CORPORATION, Richmond, VA (US)

( * ) Notice: Subject to any disclaimer, the term of this patent is extended or adjusted under 35 U.S.C. 154(b) by 60 days.

(21) Appl. No.: 14/792,321

(22) Filed: Jul. 6, 2015

(65) Prior Publication Data

US 2017/0009175 A1 Jan. 12, 2017

(51) Int. Cl.
*C10M 133/06* (2006.01)
*C10M 141/10* (2006.01)

(52) U.S. Cl.
CPC ..... *C10M 141/10* (2013.01); *C10M 133/06* (2013.01); *C10M 2207/04* (2013.01); *C10M 2215/04* (2013.01); *C10M 2223/043* (2013.01); *C10N 2230/06* (2013.01); *C10N 2230/12* (2013.01); *C10N 2230/44* (2013.01); *C10N 2240/40* (2013.01); *C10N 2270/02* (2013.01)

(58) Field of Classification Search
CPC ..... C10M 141/10; C10M 133/06; C10M 2207/04; C10M 2215/04; C10M 2223/043; C10N 2230/06; C10N 2230/12; C10N 2230/44; C10N 2240/40
USPC ..... 508/431
See application file for complete search history.

(56) References Cited

U.S. PATENT DOCUMENTS

| | | | | |
|---|---|---|---|---|
| 2,420,328 | A | 5/1947 | Shipp et al. | |
| 2,728,647 | A | 12/1955 | Vaughn | |
| 3,035,905 | A | 5/1962 | Keller | |
| 3,203,895 | A | 8/1965 | Latos et al. | |
| 3,324,182 | A * | 6/1967 | De Brunner et al. | C10M 3/00 508/558 |
| 3,361,668 | A | 1/1968 | Wiese | |
| 3,668,237 | A * | 6/1972 | Cyba | C07F 9/3211 106/18.2 |
| 3,933,658 | A | 1/1976 | Beiswanger et al. | |
| 4,774,351 | A | 9/1988 | Forsberg | |
| 5,039,713 | A | 8/1991 | Petrella | |

(Continued)

FOREIGN PATENT DOCUMENTS

| | | |
|---|---|---|
| GB | 1 319 121 A | 6/1973 |
| WO | WO 2010/004118 A1 | 1/2010 |

OTHER PUBLICATIONS

Extended European Search Report for European Application No. 14164110.0 dated Sep. 19, 2014.

*Primary Examiner* — James Goloboy
(74) *Attorney, Agent, or Firm* — Mendelsohn Dunleavy, P.C.

(57) ABSTRACT

The present invention generally relates, in certain aspects, to corrosion inhibiting compositions useful for metalworking fluids, as well as concentrates, additives and metalworking fluids containing such compositions. The invention furthermore relates, in some aspects, to the use of such compositions for providing to a metalworking fluid one or more of anticorrosion performance, antifoam performance, antiwear performance, load carrying capacity, long fluid life, biological stability, lubricity, hard water tolerance, formulation stability.

20 Claims, 2 Drawing Sheets

(56) References Cited

U.S. PATENT DOCUMENTS

| | | | | |
|---|---|---|---|---|
| 5,650,097 | A | 7/1997 | Wysong et al. | |
| 6,103,675 | A * | 8/2000 | Pyka | C10M 137/08 508/429 |
| 6,111,054 | A | 8/2000 | Haubennestel et al. | |
| H2233 | H | 11/2009 | Kramer | |
| 2014/0106997 | A1* | 4/2014 | DeSantis | C10M 141/12 508/185 |
| 2015/0011445 | A1* | 1/2015 | Temme | C11D 3/30 508/530 |

* cited by examiner

BORON FREE CORROSION INHIBITORS FOR METALWORKING FLUIDS

FIELD

The present invention generally relates, in certain aspects, to corrosion inhibiting compositions useful for metalworking fluids, as well as concentrates, additives and metalworking fluids containing such compositions. The invention furthermore relates, in some aspects, to the use of such compositions for providing to a metalworking fluid one or more of anticorrosion performance, antifoam performance, antiwear performance, load carrying capacity, long fluid life, biological stability, lubricity, hard water tolerance, formulation stability.

BACKGROUND

Metalworking conditions promote corrosion of the metal surfaces involved. This is particularly relevant for ferrous metal, but not restricted thereto, e.g., copper may suffer from serious corrosion damage upon metalworking without adequate corrosion protection. Therefore, metalworking fluids usually contain corrosion inhibitors to protect the metal surfaces from corrosion. Metalworking fluids for machining ferrous and non-ferrous metals such as copper or aluminum and their alloys are generally water-based soluble oils that, upon dispersion in water, form transparent, translucent, semi-translucent, or milky emulsions. The oil employed is usually mineral oil-based and often contains such additives as natural fatty oils, synthetic esters or naturally sourced fatty acids, e.g., those that are biodegradeable. Said emulsions are susceptible to biological attack and are therefore generally treated with anti-microbial additives (biocides). Mineral oil-containing water miscible products generally contain emulsifier additives and hence can suffer from biological attack. They may have poor longevity because the emulsified phase containing the mineral oil tends to separate out.

Metalworking fluids often make use of amine borate containing corrosion inhibitors. Amine borate containing corrosion inhibitors are known to provide very good corrosion inhibition and, in addition, have biocidal activity. Such activity is in principle desirable as metalworking fluids contain contain water and oil—and thus, are prone to biological growth. Microbiological contamination within a metalworking fluid has detrimental effect on the life of the fluid, as it degrades certain components of the fluid, such as sodium petroleum sulphonates. The use of amine borate corrosion inhibitors therefore reduces the biocide requirements for the metalworking fluid.

However, amine borates are known to have a negative environmental impact, cause health hazards, and are generally undesirable in industrial applications. Consequently, there is a need for the reduction or elimination of the use of amine borates. In the past, several amine corrosion inhibitors have been suggested to replace amine borates. Among these amines, dicyclohexylamine, 3-amino-4-octanol, monoethanolamine and triethanolamine have seen commercial application. However, corrosion inhibition using these inhibitors is generally attributed merely to their basic nature. For example, dicyclohexylamine faces a decline in acceptance due to it being a secondary amine, which, in the presence of nitrites, form nitrosamines which are known to be toxic. In addition, corrosion inhibition provided by these amine substitutes generally does not compare to the performance shown by conventional amine borates. Thus, whereas there are a number of additives available that can provide some of the attributes of amine borates, there are no readily available alternatives that can be used in place of the amine borate derivatives to match all the attributes required, and at the same time meet future environmental and health safety standards.

To address this, a compound is needed that works as a boron-free corrosion inhibitor and provides corrosion inhibition, biostability, hard water tolerance, low foam, formulation stabilization, and/or lubricity.

BRIEF DESCRIPTION OF THE DRAWINGS

Non-limiting embodiments of the present invention will be described by way of example with reference to the accompanying figures, which are schematic and are not intended to be drawn to scale. In the figures, each identical or nearly identical component illustrated is typically represented by a single numeral. For purposes of clarity, not every component is labeled in every figure, nor is every component of each embodiment of the invention shown where illustration is not necessary to allow those of ordinary skill in the art to understand the invention. In the figures.

DETAILED DESCRIPTION

Figure 1:
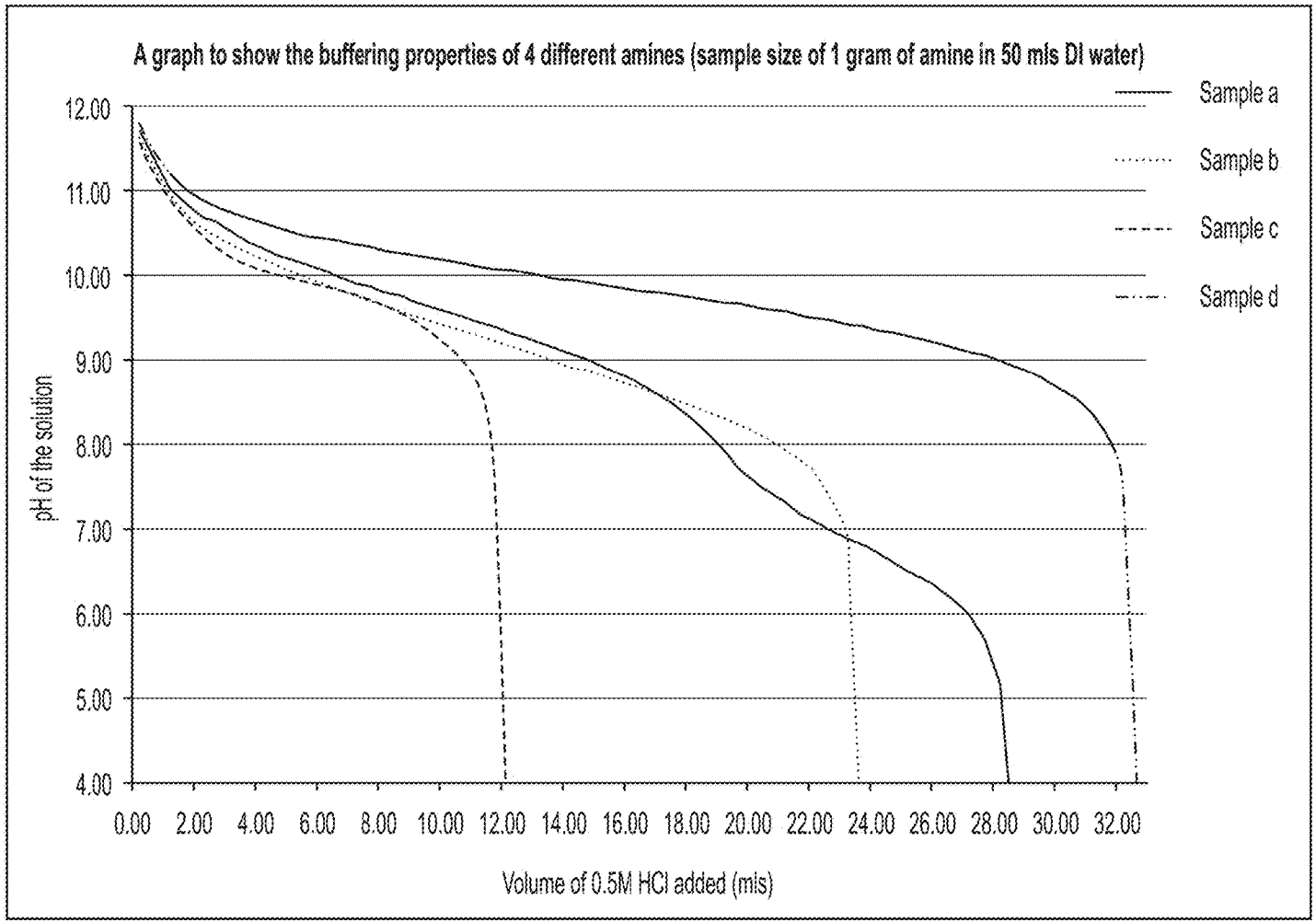
FIG. 1 illustrates the buffering properties of four different amines, in accordance with certain embodiments of the invention.

As a solution to one or more of the above-mentioned objects and needs, the present invention discloses, in some embodiments, a composition comprising one or more amines according to Formula (I):

Formula (I)

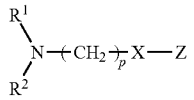

and one or more acid phosphates capable of forming a salt with an amine according to Formula (I), wherein X is selected from O and $NR^3$, Z is hydrogen, $R^4$ or $—(CH_2)_q—N(R^5)R^6$, p is an integer from 1 to 5 (e.g., 1, 2, 3, 4, or 5), q is an integer from 1 to 5 (e.g., 1, 2, 3, 4, or 5), $R^1$, $R^2$, $R^3$, $R^4$, $R^5$, $R^6$ are independently selected from hydrogen, linear, or branched $C_{1-4}$ alkyl, hydroxyalkyl or alkoxyalkyl, or $R^1$ and $R^2$ and/or $R^5$ and $R^6$ together form a cyclic morpholino group. In some cases, this is with the proviso that the amines according to Formula (I) do not comprise a terminal secondary amino group. In some embodiments, p and q are equal, although they need not be.

In another set of embodiments, the composition comprises one or more amines according to Formula (VII):

Formula (VII)

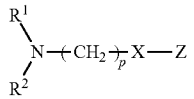

and one or more acid phosphates capable of forming a salt with an amine according to Formula (VII), wherein X is selected from O and $NR^3$, Z is $—(CH_2)_q—N(R^4)R^5$, p is an integer from 1 to 5 (e.g., 1, 2, 3, 4, or 5), q is an integer from 1 to 5 (e.g., 1, 2, 3, 4, or 5), each of $R^1$ and $R^2$, independently is linear or branched $C_{1-4}$ alkyl, hydroalkyl or alkoxyalkyl; $R^3$, $R^4$, and $R^5$ are independently selected from hydrogen, linear, or branched $C_{1-4}$ alkyl, hydroxyalkyl or alkoxyalkyl, or $R^1$ and $R^2$ and/or $R^4$ and $R^5$ together form a cyclic morpholino group.

In yet another set of embodiments, the composition comprises one or amines according to Formula (IX):

Formula (IX)

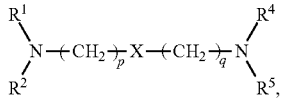

and one or more acid phosphates capable of forming a salt with an amine according to Formula (IX), wherein X is selected from O and $NR^3$, Z is $—(CH_2)_q—N(R^4)R^5$, p is an integer from 1 to 5, q is an integer from 1 to 5, each of $R^1$ and $R^2$, independently is linear or branched $C_{1-4}$ alkyl, hydroalkyl or alkoxyalkyl; $R^3$, $R^4$, and $R^5$ are independently selected from hydrogen, linear, or branched $C_{1-4}$ alkyl, hydroxyalkyl or alkoxyalkyl, or $R^1$ and $R^2$ and/or $R^4$ and $R^5$ together form a cyclic morpholino group.

Preferred compositions according to some embodiments of the present invention may comprise one or more amines according to Formula (II)

$$R^1{}_2N\text{-}(CH_2)_p—X\text{-}(CH_2)_p—NR^1{}_2$$ Formula (II)

and one or more acid phosphates capable of forming a salt with an amine according to Formula (II), wherein X is selected from O and $NR^3$, p is an integer from 1 to 5 (e.g., 1, 2, 3, 4, or 5), $R^1$ and $R^3$ are independently selected from hydrogen, linear or branched $C_{1-4}$ alkyl, hydroxyalkyl or alkoxyalkyl, or two $R^1$ moieties together form a cyclic morpholino group. In some cases, $R^1$ and/or $R^3$ may be methyl.

The compositions can generally be made, for example, by combining both components and any eventual additives or adding both components and any eventual additives to a liquid.

It is to be understood that a portion or all of the amine may react with a portion or all of the acid phosphate forming a phosphate amine salt, also known as an ammonium phosphate salt.

In a preferred embodiment, the acid phosphate capable of forming a salt with an amine according to Formula (I), Formula (VII), or Formula (II) is one or more acid phosphates according to Formula (III):

Formula (III)

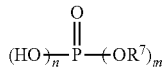

wherein $R^7$ is linear or branched (poly)oxyalkylene having a molecular weight in the range from 45 to 800, n being 1 or 2, m being 1 or 2, and n+m being 3.

The phosphate amine salt may also be described by Formula (IV) in another embodiment, Formula (IV)

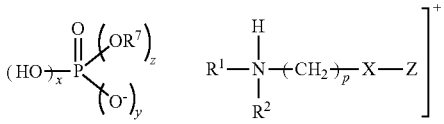

obtainable by combining one or more acid phosphates according to Formula (III) and one or more amines according to Formulae (I), wherein $R^1$, $R^2$, $R^7$, X, Z and p for Formula (IV) are as defined above for Formula (I), and x is 0 or 1, y is 1 or 2, z is 1 or 2 and x+y+z is 3. It is to be understood that Formula (IV) does not restrict the presence of the quaternary nitrogen atom to one of an outer (terminal) amine function. In case X is $NR^3$, the central nitrogen may as well be the position of protonation upon salting, as well as the group $—(CH_2)_q—N(R^5)R^6$.

Another preferred embodiment is described by Formula (VIII):

Formula (VII)

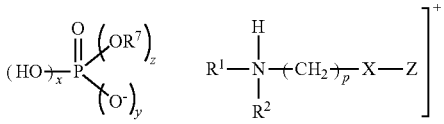

obtainable by combining one or more acid phosphates according to Formula (III) and one or more amines according to Formulae (VII), wherein $R^1$, $R^2$, $R^7$, X, Z and p for Formula (IV) are as defined above for Formula (VII), and x is 0 or 1, y is 1 or 2, z is 1 or 2 and x+y+z is 3. It is to be understood that Formula (VIII) does not restrict the presence of the quaternary nitrogen atom to one of an outer (terminal) amine function. In some embodiments, the central nitrogen may be the position of protonation upon salting, as well as the group $—(CH_2)_q—N(R^5)R^6$.

Still another preferred embodiment is described by Formula (V):

Formula (V)

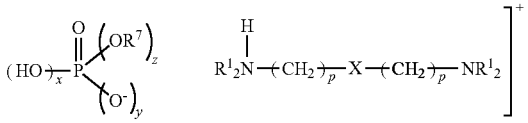

obtainable by combining one or more acid phosphates according to Formula (III) and one or more amines according to Formula (II), wherein $R^1$, $R^7$, X and p for Formula (V) are as defined above, and x is 0 or 1, y is 1 or 2, z is 1 or 2 and x+y+z is 3.

In some embodiments, $R^7$ of any of the above formulae is represented by the following Formula (VI):

Formula (VI)

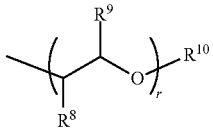

wherein $R^8$ and $R^9$ are independently hydrogen or $C_{1-4}$ alkyl, e.g., hydrogen or methyl, $R^{10}$ is $C_{1-36}$ linear, or branched alkyl, cycloalkyl, alkenyl, cycloalkenyl, aryl or aralkyl, in particular linear or branched $C_{1-18}$ alkyl, preferably $C_{8-10}$ alkyl, r is an integer from 1 to 10, e.g., 2 to 8, or 3 to 5.

Therefore, another set of embodiments of the invention is generally directed to a composition comprising a phosphate amine salt or mixture of phosphate amine salts, for example, phosphate amine salts according to Formula (IV), Formula (V), or Formula (VIII), obtainable by combining one or more acid phosphates, e.g., according to Formula (III) and one or more amines according to Formula (I), Formula (II), or Formula (VII).

The relative amounts of acid phosphate, preferably according to Formula (III), and amine according to Formulae (I), (VII), or (II) may vary in the range of 0.6:1 to 1.4:1 (wt/wt) phosphate to amine, 0.8:1 to 1.2:1 (wt/wt) phosphate to amine, or 0.9:1 to 1.1:1. For example, the ratio may be 1:1 (wt/wt) phosphate to amine. Often the acid phosphate will be employed as a mixture of mono- and divalent acid. The molar ratio of monovalent to divalent may be, for instance, in the range of 1:0.1 to 1:1.5, 1:0.2 to 1:1, or 1:0.4 to 1:0.8. The addition of amine to the acid phosphate (or vice versa) is referred to as "salting" in the art. The degree of salting may determine whether the resulting compound is oversalted, undersalted or, "neutral," i.e., resulting in equimolar amounts of ammonium ion derived from the amine of Formula (I), Formula (VII), or Formula (II) and phosphate acid/deprotonated phosphate acid equivalents.

In one embodiment, salting of the acid phosphate or mixture of acid phosphates with said one or more amine(s) of Formula (I), Formula (VII), or Formula (II) results in a mixture comprising, on a relative weight basis, 50% to 90%, 60% to 80%, or 65% to 72%, e.g., about 70% or 63% to 69%, of the amine salt(s) and 50% to 10%, 40% to 20%, or 38% to 25%, e.g., about 30% or 31% to 37%, of unreacted free amine. Combinations of any of these ranges are also possible. Usually, the salted phosphate amine is a gel, often of high viscosity. However, the salted phosphate amine may also be obtained as a crystalline or amorphous solid, or as a liquid, at normal conditions.

Acid phosphates to be employed in various embodiments of the present invention include those wherein $R^7$ in the formulae above has a molecular weight of 200 to 400, such as between 300 and 350. For instance, the alkoxylated phosphate of Formula (II) may be prepared by reaction of phophorus pentoxide with a polyoxyalcohol $R^7OH$, yielding a mixture of phosphate monoesters and diesters, reflected by indices n and m in Formula (II). The same is generally true for other phosphate formulae described herein.

Useful phosphates include, but are not limited to: 2-ethylhexyl phosphate, iso-nonanol phosphate, octyl/decyl ethoxylate phosphate, octyl/decyl ethoxylate (4EO) phosphate, 2-ethylhexyl ethoxylate (3EO) phosphate, 2-ethylhexyl ethoxylate (2EO) phosphate, 2-ethylhexyl ethoxylate (4EO) phosphate, decyl alcohol ethoxylate (4EO) phosphate, decyl alcohol ethoxylate (6EO) phosphate, isotridecanol ethoxylate (3EO) phosphate, isotridecanol ethoxylate (6EO) phosphate, isotridecanol ethoxylate (5EO) phosphate, isotridecanol ethoxylate (10EO) phosphate, isotridecanol ethoxylate (20EO) phosphate, Tergitol 15-S-9 phosphate, $C_{10-14}$ alcohol ethoxylate (3EO) phosphate, $C_{12}$ alcohol ethoxylate (4EO) phosphate, $C_{12-14}$ alcohol ethoxylate (4EO) phosphate, $C_{12-15}$ alcohol ethoxylate (5EO) phosphate, cetyl/stearyl alcohol ethoxylates (2EO) phosphate, cetyl/oleyl alcohol ethoxylate (5EO) phosphate, oleyl alcohol ethoxylate (4EO) phosphate, alkyl phenol ethoxylate phosphate, phenol ethoxylate (3EO) phosphate, or phenol ethoxylate (6EO) phosphate. Expressions such as "octyl/decyl ethoxylate" used herein describe mixtures of octyl ethoxylate and decyl ethoxylate. In some cases, more than one of these may be present, e.g., in a composition as described herein. Among the most preferred phosphates are: octyl/decyl ethoxylate (4EO) phosphate, decyl alcohol ethoxylate (4EO) phosphate, $C_{12}$ alcohol ethoxylate (4EO) phosphate, or $C_{12-14}$ alcohol ethoxylate (4EO) phosphate, although these are described by way of example and not limitation.

According to naming conventions in the art, the "alcohol"/"phenol" portion of the name reflects that the "alcohol ethoxylate" or "phenol ethoxylate" is the reaction product of an alcohol/phenol and ethylene oxide. Therefore, e.g., "decyl ethoxylate (4EO) phosphate" or "decyl alcohol ethoxylate (4EO) phosphate" or "decanol ethoxylate (4EO) phosphate" mean the same compound: $C_{10}H_{21}O(C_2H_4O)_r$ phosphate, wherein r is approximately 4. The naming convenion reflects the average number of repeating units, —$OCH_2CH_2$—, in the alcohol/phenol and ethylene oxide reaction product, $R^{11}$—$(OCH_2CH_2)_b$—OH, where $R^{11}$ is the alkyl portion of the initial alcohol/phenol. Small variations from the integer are meant to be covered, e.g., +/−0.1, +/−0.2, +/−0.3, +/−0.4, or +/−0.5, and any suitable combination of any of these. Therefore as an example, "4EO" may comprise a sample having between 3.5 and 4.4 —$OCH_2CH_2$— repeating units, such as, in particular, 3.9 to 4.0 —$OCH_2CH_2$— repeating units.

The amine according to Formula (I), Formula (VII), or Formula (II) employed may have no terminal secondary nitrogen atom in some embodiments, as secondary amines may be a health hazard. Residues $R^1$, $R^2$, $R^3$, $R^4$, and $R^5$ may be the same or different, and independently can be one of the following. A residue may independently be a linear or branched $C_1$ to $C_5$ alkyl ($C_1$, $C_2$, $C_3$, $C_4$, $C_5$) or a $C_1$ to $C_5$ ($C_1$, $C_2$, $C_3$, $C_4$, $C_5$) hydroxyalkyl. The $C_1$ or $C_5$ hydroxyalkyl may be linear or branched (e.g., methyl, ethyl, propyl, isopropyl, butyl, isobutyl, secbutyl, tertbutyl, etc.), and may have 1, 2, 3, or 4 or more —OH moiteies present (e.g., hydroxymethyl, 1-hydroxyethyl, 2-hydroxyethyl, 1,2-dihydroxypropyl, 2-hydroxypropyl, etc.). In addition, in some instances, a residue may be a alkoxyalkyl; in some embodiments, each alkyl moiety of the alkoxyalkyl group may independently be a linear or branched $C_1$ to $C_5$ alkyl ($C_1$, $C_2$, $C_3$, $C_4$, $C_5$) or a linear or branched $C_1$ to $C_5$ ($C_1$, $C_2$, $C_3$, $C_4$, $C_5$) hydroxyalkyl moiety. In addition, in some embodiments, $R^1$ and $R^2$ together (and/or $R^3$ and $R^4$ together) may form a cyclic morpholino group. The amine may have 1, 2, or 3 nitrogen atoms, or more in some embodiments. In some cases, the amine may also be an ether. In some embodiments, $R^1$ and $R^4$ have the same structure, and $R^2$ and $R^5$ have the same structure.

Non-limiting examples of suitable amines for use with various embodiments of the invention include:

Bis(N-dimethylaminopropyl)methylamine

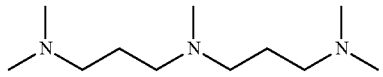

Bis(N-aminopropyl)methylamine

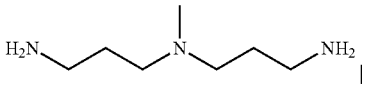

Bis(N-dimethylaminoethyl)methylamine

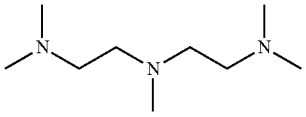

Bis(N-aminoethyl)methylamine

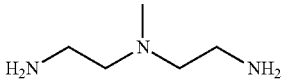

Bis(dimethylaminoethyl)ether

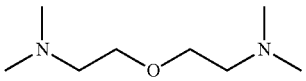

Bis(dimethylaminopropyl)ether

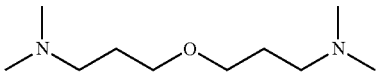

Bis(aminoethyl)ether

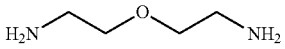

Bis(aminopropyl)ether

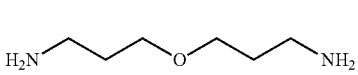

Bis(3-dimethylaminopropyl)isopropanolamine

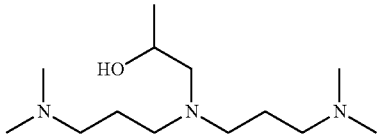

3-dimethylaminopropyldiisopropanolamine

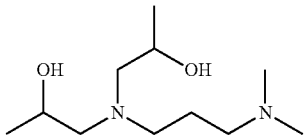

2-(2-dimethylaminoethoxy)ethanol

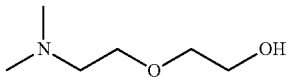

2-(2-dimethylaminoethoxyethyl)-methylamino-ethanol

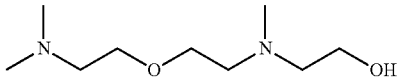

2,2-dimorpholinoethylether

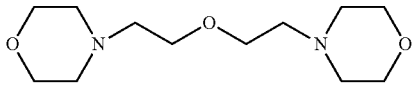

2-(2-dimethylaminoethyl)-methylamino-ethanol

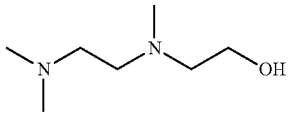

Bis(N-dimethylaminopropyl)amine

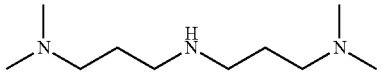

Preferred amines include, but are not limited to: bis(N-dimethylaminopropyl)methylamine, bis(N-dimethylaminoethyl)methylamine, Bis(dimethylaminoethyl)ether, bis(3-dimethylaminopropyl)isopropanolamine, 3-dimethylaminopropyldiisopropanolamine, or 2-(2-dimethylaminoethoxy)ethanol.

Combinations of any of the aforementioned phosphates and amines are also possible; in addition, more than one of the phosphates and/or more than one of the amines may be present, and/or other phosphates and/or amines may be present. Examples of specific phosphate amine salts include, but are not limited to: octyl/decyl 4EO phosphate salted with bis(N-dimethylaminopropyl)methylamine, or bis(N-dimethylaminopropyl)methylamine, or bis(N-dimethylaminoethyl) methylamine, or bis(dimethylaminoethyl)ether, or bis(3-dimethylaminopropyl)isopropanolamine, or 3-dimethylaminopropyldiisopropanolamine, or 2-(2-dimethylaminoethoxy)ethanol.

Thus, in an amine phosphate salt according to one example embodiment of the present invention, the amine is bis(N-dimethylaminopropyl)methylamine and the phosphate is obtained by the reaction of phosphorus pentoxide with octyl/decyl ethoxylate (4EO). The octyl/decyl ethoxylate (4EO) is obtained by the reaction of 4 moles of ethylene oxide for every 1 mole of $C_8$ and $C_{10}$ alcohol.

In some embodiments, a composition such as is described herein may be advantageously used in a metalworking fluid. The composition may provide good anticorrosion performance, e.g., comparable or better than that observed with conventional amine borate corrosion inhibitors. In addition, it has been surprisingly found that some compounds of the invention provide good life to the metalworking fluid, comparable to that obtained with conventional amine borate based corrosion inhibitors-without the environmental concerns and health hazard associated with amine borates. Some compositions of the present invention have been shown to inhibit or slow bacterial growth over extended periods of time. The long life functionality action of certain compositions of the present invention may be considered to be a significant improvement compared to the environmental impact inherent to conventional bacteriocidal amine borate based corrosion inhibitors. Use of some composition of the present invention may, in addition, reduce the need to apply conventional biocides in metalworking.

The buffering properties of some compositions of the present invention may be equal or superior to conventional corrosion inhibitors used in metalworking fluids and add to the anticorrosive properties. Certain compositions of the present invention provide good antiwear performance to a metalworking fluid combined with high load carrying capacity, comparable or superior to corrosion inhibitors conventionally used in metalworking fluids.

These properties make certain compositions of the present invention ideal corrosion inhibitors for metalworking fluids. They can be employed, for example, as an additive package, or as a component of an additive package for metalworking fluids. In some cases, the additive package is diluted to make the finished metalworking fluid. Thus, the present invention also relates, in some embodiments, to an additive package comprising 1 wt % to 50 wt %, 5 wt % to 40 wt %, 10 wt % to 40 wt %, or 25 wt % to 30 wt % of a composition of a total of compounds of Formulae (I), (VII), (III), (IV), (VIII), and/or (V). It is to be understood that the additive package may comprise or consist essentially of a composition of Formulae (I) and (III); or (I), (III) and (IV); or (IV) alone in various embodiments. Additional examples include, but are not limited to Formulae (VII) and (III); or Formulae (VII), (III), and (IV). In addition, in some embodiments, the additive package may comprise or consist essentially of a composition of Formulae (II) and (III); or (II), (III) and (V); or (V) alone. In some embodiments, the additive package may comprise 1 wt % to 50 wt %, 5 wt % to 40 wt %, 10 wt % to 40 wt %, or 25 wt % to 30 wt % of a composition of Formula (IV), Formula (VIII), and/or Formula (V), as well as combinations of any of these formulae.

The additive package may further comprise any suitable amount of an oil, e.g., 0 wt % to 90 wt %, 10 wt % to 80 wt % of oil, preferably a mineral oil such as (but not limited to) API Group I (including naphthenic and paraffinic), API Group II (including paraffinic), with a viscosity grade from 10 cSt to 50 cSt, preferably 20 cSt to 40 cSt. The additive package may further comprise, in some embodiments, 0 wt % to 50 wt %, or 5 wt % to 30 wt %, e.g., less than 15 wt % water. The additive package for metalworking fluid according to some embodiments of the present invention may further include one or more of additional conventional components such as additional corrosion inhibitor, biocides, fungicides, emulsifier, lubrication additives, couplers, solution stabilizers, antifoaming agents, etc.

A typical example additive package, or concentrate, of the present invention may be composed as follows (Table 1):

TABLE 1

| Component/Function | % by weight |
|---|---|
| Diluents | ~10-12 |
| Lubricants | ~40-50 |
| Corrosion Inhibitors | ~27-29 |
| Emulsifiers | ~8-9 |
| Alcohols | ~5-6 |

An example of a suitable diluent is water.

Examples of suitable lubricants are, independently or a mixture of, polyricinoleic acid ester, fatty acid ester, triglycerides, EP/PO block copolymers, and polymeric esters available under the trade name Ketjenlube 135.

Examples of suitable corrosion inhibitors are octyl decyl 4EO phosphate salted with bis(N-diemethylaminopropyl) methylamine, alone or in combination, with other corrosion inhibitors such as amine carboxylates, tolytriazoles, benzotriazoles, thiadiazoles, calcium alkylbenzene sulfonates available under the trade name HiTEC® 614, and fatty acid alkanolamine available under the trade name Polartech Amide MA 460™.

Examples of suitable emulsifers are, independently or a mixture of two or more of, sulfonates, fatty acid amides, alcohol ether carboxylates available under the trade name Akypo RO 50 VG, alkyl ether carboxylates available as the trade name Akpo Tec AMVG, and ethoxylates, such as fatty acid ester alkoxylate available under the trade name Surfonic MW 100.

Examples of suitable alcohols are, independently or a mixture of two or more of, oelyl cetyl alcohol available under the trade name Synative AL 90/95 V and $C_{12}$-$C_{14}$ linear alcohol available under the trade name Synative AL S.

Accordingly, a specific non-limiting example of a typical additive package, or concentrate, of the present invention may be composed as follows (Table 2):

TABLE 2

| Component | Function | % (by weight) |
|---|---|---|
| Water | Diluent | 11.5 |
| Polartech LA 8005, | Lubricant | 45.7 |

TABLE 2-continued

| Component | Function | % (by weight) |
|---|---|---|
| polyricoleic acid ester | Corrosion | 28.5 |
| Octyl/decyl 4EO Phosphate ester salted with - Bis(N-dimethylaminopropyl)methylamine | Inhibitor | |
| Akypo RO 50 VG, alcohol ether carboxylate | Emulsifier | 8.6 |
| Synative AL S, C12-C14 linear alcohol | Alcohol | 5.7 |

The present invention also relates, in certain embodiments, to the finished metalworking fluid comprising compositions as discussed herein. The metalworking fluid may be manufactured, for example, by adding the composition or the additive package to a fluid. The finished metalworking fluid comprises from 1 wt % to 20 wt %, 2 wt % to 8 wt %, 4 wt % to 6 wt % or about 5 wt % of a composition comprising compounds of Formulae (I), (III), and (IV); (VII), (III), and (VIII); or (II), (III) and (V). In some embodiments, the finished metalworking fluid may comprise 1 wt % to 20 wt %, 2 wt % to 10 wt %, 2 wt % to 8 wt %, 4 wt % to 6 wt %, or about 5 wt % of a composition of Formula (IV), (VIII), or (V). The finished metalworking fluid may further comprise any suitable amount of an oil, e.g., 0 wt % to 90 wt %, or 1 wt % to 80 wt %, of an oil, preferably a mineral oil such as (but not limited to) API Group I (including naphthenic and/or paraffinic), API Group II (including paraffinic), with a viscosity grade from 10 cSt to 50 cSt, preferably 20 cSt to 40 cSt. Alternatively, or in addition, the finished metalworking fluid may further comprise 0 wt % to 60 wt %, or 5 wt % to 30 wt %, e.g., less than 15 wt % water. For example, a finished metalworking fluid containing a typical additive package, or concentrate, may have the following physical parameters: density at 15.6° C. of 0.9 to 1.2, total alkalinity between 10% to 15% as KOH, water content of between 5% to 15%.

A finished metalworking fluid according to some embodiments of the invention may further include one or more of additional conventional components such as additional corrosion inhibitor, biocides, fungicides, emulsifier, lubrication additives, couplers, solution stabilizers, antifoaming agents, etc.

A typical metalworking fluid of the present invention may, e.g., be composed as follows (Table 3):

TABLE 3

| Component/Function | % by weight |
|---|---|
| Base Oil | ~30-50 |
| Sulphonates | ~3-5 |
| Fatty acids | ~7-10 |
| Alcohols | ~4-6 |
| pH neutralizers | ~7-10 |
| Metal passivators | ~0-1 |
| Lubricants | ~8-10 |
| Corrosion Inhibitor (invention) | ~4-6 |
| Other corrosion inhibitors | ~0-7 |
| Emulsifiers | ~0.1-1 |
| Fungicides | ~0.1-1 |
| Diluents | ~20-25 |
| Antifoams | ~0.1-0.5 |

An example of a suitable base oils is a naphthenic mineral oil available under the trade name Nynas T22.

An example of a suitable sulphonate is sodium petroleum sulphonate available under the trade name Petronate HL.

Examples of suitable fatty acids are, independently or a mixture of two or more of, tall oil fatty acid available under the trade name Sylfat 2 and monocarboxylic $C_{10}$ acid available under the trade name of Versatic 10, oleic acid.

Examples of suitable alcohols are, independently or a mixture of two or more of, oelyl cetyl alcohol available under the trade name Synative AL 90/95 V, and $C_{12}$-$C_{14}$ linear alcohol available under the trade name Synative AL S.

Examples of suitable amines are, independently or a mixture of two or more of, monoisopropanolamine, diethanolamine, and triethanolamine.

Examples of suitable metal passivators are, independently or a mixture of two or more of, tolytriazole available under the trade anme Polartech Multitech Cu and benzotriazole available under the trade name Irgamet 42.

Examples of suitable lubricants are, independently or a mixture of, polyricinoleic and polymeric ester available under the trade name Ketjenlube 135.

Examples of suitable corrosion inhibitors are octyl decyl 4EO phosphate salted with bis(N-diemethylaminopropyl) methylamine, alone or in combination with other corrosion inhibitors, such as amine carboxylates, tolytriazoles, benzotriazoles, thiadiazoles, calcium alkylbenzene sulfonates available under the trade name HiTEC® 614, and fatty acid alkanolamine available under the trade name Polartech Amide MA 460™.

Examples of suitable emulsifiers are, independently or a mixture of two or more of, sulfonates, fatty acid amides, alcohol ether carboxylates available under the trade name Akypo RO 50 VG, alkyl ether carboxylates available as the trade name Akpo Tec AMVG, and ethoxylates, such as fatty acid ester alkoxylate available under the trade name Surfonic MW 100.

An example of suitable fungicides may be independently or a mixture of two or more of triazine, nitromorpholine, bromonitriles.

An example of a suitable diluent may be water.

Examples of suitable antifoams are, independently or a mixture of two or more of, silicone antifoams available under the trade names Foamban MS525 and Tego MR2124.

Accordingly, a specific non-limiting example of a typical metalworking fluid of the present invention may, e.g., be composed as follows (Table 4):

TABLE 4

| Component | Function | % (by weight) |
|---|---|---|
| Nynas T22, Napthenic base oil | Mineral Oil | 31.80 |
| Petronate HL, Sodium petroleum sulphonate | Sulphonate | 4.00 |
| Polartech Amide MA 460 TM, Fatty acid alkanolamine | Amide | 4.00 |
| Sylfat 2, Tall oil fatty acid | Fatty Acid | 4.00 |
| Synative AL 90/95 V, Oleyl cetyl alcohol | Alcohol | 5.00 |
| Monoisopropanolamine | Amine | 6.00 |
| Versatic 10, Monocarboxylic C10 acid | Fatty Acid | 4.00 |
| Triethanolamine, 99% | Amine | 2.80 |
| Polartech Multitect Cu, Tolytriazole | Metal passivator | 0.50 |
| Polartech LA 8005, polyricinoleic acid Ester, | Lubricant | 6.00 |
| X 18805, Octyl/decyl 4EO Phosphate ester salted with - Bis(N-dimethylaminopropyl)methylamine | Corrosion Inhibitor | 5.00 |
| Hitec 614, low base calcium alkylbenzene sulfonate | Corrosion Inhibitor | 1.00 |
| Ketjenlube 135, Polymeric ester | Lubricant | 3.50 |
| Akypo Tec AMVG, Alkyl Ether carboxylate | Emulsifier | 0.50 |

TABLE 4-continued

| Component | Function | % (by weight) |
|---|---|---|
| IPBC 30% | Fungicide | 0.50 |
| Water | Diluent | 21.00 |
| Foamban MS525, Silicone antifoam | Antifoam | 0.20 |
| Tego MR2124, Silicone antifoam | Antifoam | 0.20 |

The following examples are intended to illustrate certain embodiments of the present invention, but do not exemplify the full scope of the invention.

Example 1

Corrosion Inhibition Data

The following metalworking fluids, samples 1 to 6, were formulated to comparable pH (Table 5).

TABLE 5

| | Sample a inventive | Sample b inventive | Sample c reference | Sample d reference | Sample e reference | Sample f reference |
|---|---|---|---|---|---|---|
| Amine Borates | 0% | 0% | 0% | 0% | 100 wt % | 100 wt % |
| Amines | 50 wt % | 50 wt % | 50 wt % | 50 wt % | 0% | 0% |
| Ethoxylated phosphate ester | 50 wt % | 50 wt % | 50 wt % | 50 wt % | 0% | 0% |
| pH at 5% in DI water | 9.95 | 9.84 | 9.71 | 9.97 | | |
| Free amine | 36.36 wt % | 33.65 wt % | 20.87 wt % | 13.66 wt % | | |
| IP125 at 0.5% (vol/vol) | 0/3-3 | 0/3-3 | 0/3-3 | 0/5-3 | 0/1-4 | 0/2-4 |
| IP125 at 1.0% (vol/vol) | 0/1-3 | 0/1-2 | 0/2-3 | 0/4-3 | 0/1-1 | 0/1-4 |
| IP125 at 1.5% (vol/vol) | 0/1-2 | 0/1-2 | 0/1-3 | 0/1-3 | 0/1-1 | 0/1-4 |

Sample a contains bis(N-dimethylaminopropyl)methylamine; Sample b contains bis(dimethylaminoethyl)ether; Sample c contains 3-aminooctan-4-ol; Sample d contains dicyclohexylamine; Sample e contains BA70 M, an amine borate having a boron content of approximately 7%; Sample f contains BA60 MX, an amine borate having a boron content of approximately 6%.

Figure 2:
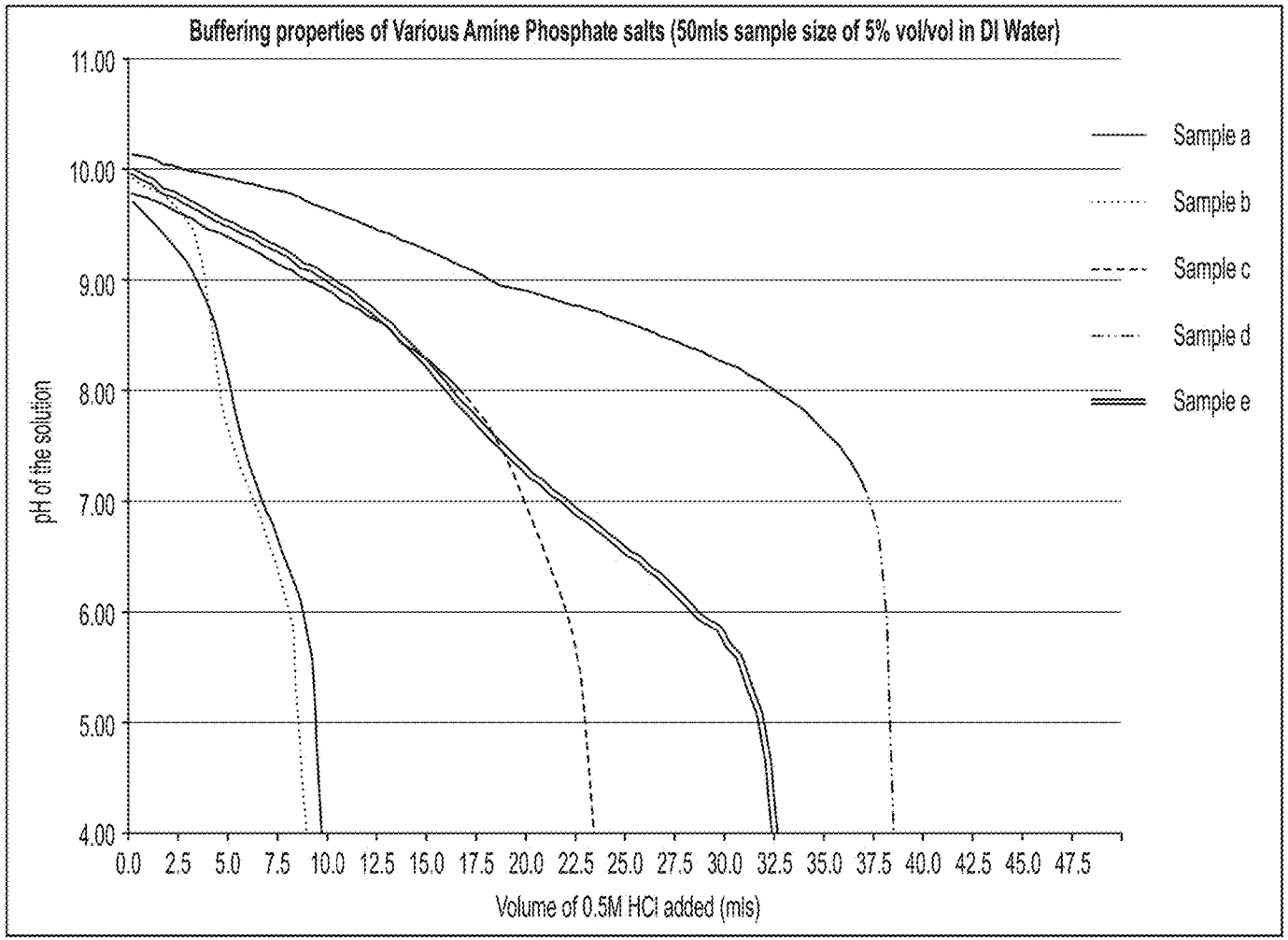
FIG. 2 illustrates the buffering properties of various amine phosphate salts, in another embodiment of invention.

Corrosion was tested according to IP287, published January 2008, ref. IP287-2934869, at 0.5 wt %, 1.0 wt %, and 1.5 wt % in 200 ppm (water as $CaCO_3$) as well as according to IP125, published January 2008, ref. IP125-2935231, at 0.5 wt %, 1.0 wt %, and 1.5 wt % in 200 ppm (water as $CaCO_3$). The IP287 results are shown in FIG. 1. FIG. 2 shows the IP125 results. IP125 results were rated by a trained technician, and reported in Table 3. The results are provided in the following form (0/3-3). The first digit—here it is 0—is the number of pits. The lower the number, the better. The second digit—here it is 3—is the % of the area stained. The lower the number, the better. The last digit—here it is 3—is the intensity of the staining. Again, the lower the number, the better.

IP 125 (reference standard: Institute of Petroleum Test Method IP 125/82) Key is as follows: The first digit is the number of pits, the second, the area of staining, and the third the maximum intensity of staining e.g. 0/1-1 (Table 6).

TABLE 6

| | Proportion of test area stained | | Intensity of staining |
|---|---|---|---|
| 0 | Nil | 0 | Nil |
| 1 | Less than 10% | 1 | Hardly perceptible |
| 2 | Between 10 and 25% | 2 | Slight staining |
| 3 | Between 25 and 50% | 3 | Heavy staining |
| 4 | Between 50 and 75% | 4 | Surface damage (not including pits |
| 5 | Over 75% | | |

It follows that the samples according to this example show at least the corrosion inhibition of conventional corrosion inhibitors on the basis of amine borates. The samples of this example show corrosion inhibition that is superior to that of conventional amine corrosion inhibitors.

Example 2

Buffering Properties of Amines

Amine buffering is the amount of a standardized acid (such as 0.5M HCl) required to reduce the pH of a fixed volume of solution from its starting pH to a pH of 4). The results below reflect testing conditions carried out at approximately 20° C. FIG. 1 shows the results of the amine buffering properties test for samples a-d. The samples contained boron free corrosion inhibitors.

Example 3

Corrosion Inhibition by Amines

TABLE 7

| | Sample a inventive | Sample b inventive | Sample c reference | Sample d reference |
|---|---|---|---|---|
| Amine | 50 wt % | 50 wt % | 50 wt % | 50 wt % |
| pH at 0.1M | 11.5 | 11.3 | 11.4 | — |
| IP125 at 0.5% (vol/vol) | 0/3-4 | 0/2-4 | 0/4-4 | — |
| IP125 at 1.0% (vol/vol) | 0/2-4 | 0/2-4 | 0/2-4 | — |

TABLE 7-continued

| | Sample a inventive | Sample b inventive | Sample c reference | Sample d reference |
|---|---|---|---|---|
| IP125 at 1.5% (vol/vol) | 0/2-4 | 0/2-4 | 0/1-4 | — |

The amine corrosion is used to evaluate the potential for machine tools and components to rust during manufacturing operations where dilutions of the metalworking fluid are used. It involves using a cast iron plate to which approximately 2 g of steel millings are added to the plate before being covered with approximately 2 ml of test fluid and left in a humidity cabinet for a fixed period of time. Table 7 shows the results of the amine corrosion test according to IP287 at 0.5 wt %, 1.0 wt %, and 1.5 wt % (vol/vol) for a period of 16 hours.

Example 4

Buffering Properties of Phosphate Amine Salt

The results are shown in FIG. 2.

Example 5

Reichert Wear Test

The Reichert Friction Wear Test is a method designed to evaluate, in terms of lubrication, a metal working fluid. The test apparatus has an electrical motor and a double armed lever system, to apply a load (typically 1500 g) to a stationary test pin, which is kept in sliding contact with a revolving steel ring that is partially immersed in the test lubricant. The volume of the sample is 25 ml. When the device is operated at a speed of 1.7 m/sec, a thin film of the lubricant adheres to the surface of the ring to help reduce the friction. The test runs for 100 minutes. Due to the initial friction an elliptical shape is produced on the test pin. The area of the scar produced by the wear increases until it is wide enough to allow the fluid to produce a stable, lubricating film between the ring and the test pin; at this point a drop off in noise can be heard and the distance recorded. When the test is over, the width and the length of the scar on the test pin is measured to calculate the area of the scar (Area of ellipse (A), $mm^2$ Length×Width×0.785); the relationship between the load applied and the area of the scar gives the load carrying capacity (effectively pressure carried by the film of lubricant). The larger the load carrying capacity, the better the lubricant.

The results show that sample a has the best load carrying capacity and sample c the worst.

Reichert testings, using steel test pins on a steel ring with an applied load of 1500 g were carried out at 0.5% concentration in deionised water, which equates to an additive level of 10% in a formulation which has then been diluted to 5%. The results are reported in Table 8.

TABLE 8

| Corrosion Inhibitor | Load Carrying Capacity $g/mm^2$ | Wear Ratio % | Noise Dropoff m | Average Scar Area $mm^2$ |
|---|---|---|---|---|
| BA70M | 92.74 | 84.9 | 100 | 32.3 |
| a | 99.87 | 72.4 | 100 | 30.0 |
| b | 91.53 | 68.9 | 100 | 32.8 |
| c | 88.44 | 95.25 | 100 | 33.9 |
| d | 93.03 | 89.78 | 100 | 32.3 |

Samples a, b, c, d were the same as in Example 1, except that samples c and d did not contain the acid phosphate.

Example 6

4-Ball Test

The test method ASTM D4172-94 covers the determination of the load carrying properties of lubricating fluids. In this particular case, it was used to evaluate the antiwear properties of certain test fluids. The method was modified for testing solutions diluted in water as follows. The 4 ball test using 40 kg fixed load for a fixed time of 60 secs, and a rotational speed of 1760 rpm, were carried out at 0.5% concentration in DIW, which equates to an additive level of 10% in a formulation which has then been diluted to 5%. Two runs were carried out for each fluid and the average measurement of the scars on the surface of the three bottom balls taken, which was then approximated as a circular (assuming symmetry) area. The results are reported in Table 9.

TABLE 9

| Corrosion Inhibitor | Average Scar measurement (mm) | Approx. Scar Area ($mm^2$) |
|---|---|---|
| BA70M | 1.65 × 1.71 | 2.22 |
| a | 0.36 × 0.39 | 0.11 |
| b | 0.36 × 0.40 | 0.11 |
| c | 1.87 × 1.75 | 2.57 |
| d | 1.80 × 1.70 | 2.41 |

Samples a, b, c, d were the same as in Example 5.

While several embodiments of the present invention have been described and illustrated herein, those of ordinary skill in the art will readily envision a variety of other means and/or structures for performing the functions and/or obtaining the results and/or one or more of the advantages described herein, and each of such variations and/or modifications is deemed to be within the scope of the present invention. More generally, those skilled in the art will readily appreciate that all parameters, dimensions, materials, and configurations described herein are meant to be exemplary and that the actual parameters, dimensions, materials, and/or configurations will depend upon the specific application or applications for which the teachings of the present invention is/are used. Those skilled in the art will recognize, or be able to ascertain using no more than routine experimentation, many equivalents to the specific embodiments of the invention described herein. It is, therefore, to be understood that the foregoing embodiments are presented by way of example only and that, within the scope of the appended claims and equivalents thereto, the invention may be practiced otherwise than as specifically described and claimed. The present invention is directed to each individual feature, system, article, material, kit, and/or method described herein. In addition, any combination of two or more such features, systems, articles, materials, kits, and/or methods, if such features, systems, articles, materials, kits, and/or methods are not mutually inconsistent, is included within the scope of the present invention.

All definitions, as defined and used herein, should be understood to control over dictionary definitions, definitions in documents incorporated by reference, and/or ordinary meanings of the defined terms.

The indefinite articles "a" and "an," as used herein in the specification and in the claims, unless clearly indicated to the contrary, should be understood to mean "at least one."

The phrase "and/or," as used herein in the specification and in the claims, should be understood to mean "either or both" of the elements so conjoined, i.e., elements that are conjunctively present in some cases and disjunctively present in other cases. Multiple elements listed with "and/or" should be construed in the same fashion, i.e., "one or more" of the elements so conjoined. Other elements may optionally be present other than the elements specifically identified by the "and/or" clause, whether related or unrelated to those elements specifically identified. Thus, as a non-limiting example, a reference to "A and/or B", when used in conjunction with open-ended language such as "comprising" can refer, in one embodiment, to A only (optionally including elements other than B); in another embodiment, to B only (optionally including elements other than A); in yet another embodiment, to both A and B (optionally including other elements); etc.

As used herein in the specification and in the claims, "or" should be understood to have the same meaning as "and/or" as defined above. For example, when separating items in a list, "or" or "and/or" shall be interpreted as being inclusive, i.e., the inclusion of at least one, but also including more than one, of a number or list of elements, and, optionally, additional unlisted items. Only terms clearly indicated to the contrary, such as "only one of" or "exactly one of," or, when used in the claims, "consisting of," will refer to the inclusion of exactly one element of a number or list of elements. In general, the term "or" as used herein shall only be interpreted as indicating exclusive alternatives (i.e. "one or the other but not both") when preceded by terms of exclusivity, such as "either," "one of," "only one of," or "exactly one of." "Consisting essentially of," when used in the claims, shall have its ordinary meaning as used in the field of patent law.

As used herein in the specification and in the claims, the phrase "at least one," in reference to a list of one or more elements, should be understood to mean at least one element selected from any one or more of the elements in the list of elements, but not necessarily including at least one of each and every element specifically listed within the list of elements and not excluding any combinations of elements in the list of elements. This definition also allows that elements may optionally be present other than the elements specifically identified within the list of elements to which the phrase "at least one" refers, whether related or unrelated to those elements specifically identified. Thus, as a non-limiting example, "at least one of A and B" (or, equivalently, "at least one of A or B," or, equivalently "at least one of A and/or B") can refer, in one embodiment, to at least one, optionally including more than one, A, with no B present (and optionally including elements other than B); in another embodiment, to at least one, optionally including more than one, B, with no A present (and optionally including elements other than A); in yet another embodiment, to at least one, optionally including more than one, A, and at least one, optionally including more than one, B (and optionally including other elements); etc.

When the word "about" is used herein in reference to a number, it should be understood that still another embodiment of the invention includes that number not modified by the presence of the word "about."

It should also be understood that, unless clearly indicated to the contrary, in any methods claimed herein that include more than one step or act, the order of the steps or acts of the method is not necessarily limited to the order in which the steps or acts of the method are recited.

In the claims, as well as in the specification above, all transitional phrases such as "comprising," "including," "carrying," "having," "containing," "involving," "holding," "composed of," and the like are to be understood to be open-ended, i.e., to mean including but not limited to. Only the transitional phrases "consisting of" and "consisting essentially of" shall be closed or semi-closed transitional phrases, respectively, as set forth in the United States Patent Office Manual of Patent Examining Procedures, Section 2111.03.

What is claimed is:

1. A composition, comprising:

one or more amines according to Formula (VII):

Formula (VII)

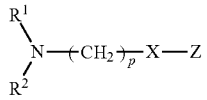

and one or more acid phosphates capable of forming a salt with an amine according to Formula (VII), wherein X is selected from O and $NR^3$, Z is $—(CH_2)_q—N(R^4)R^5$, p is an integer from 1 to 5, q is an integer from 1 to 5, each of $R^1$ and $R^2$ independently is linear or branched $C_{1-4}$ alkyl, hydroalkyl or alkoxyalkyl, $R^3$ is a linear or branched $C_1$, $C_2$, or $C_3$ alkyl, $R^4$ and $R^5$ are independently selected from hydrogen, linear, or branched $C_{1-4}$ alkyl, hydroxyalkyl or alkoxyalkyl, or $R^1$ and $R^2$ and/or $R^4$ and $R^5$ together form a cyclic morpholino group.

2. The composition of claim 1, wherein $R^1$ is methyl and $R^2$ is methyl.

3. The composition of claim 1, wherein $R^1$ and $R^4$ have the same structure, and $R^2$ and $R^5$ have the same structure.

4. The composition of claim 1, wherein X is O.

5. The composition of claim 1, wherein X is $NR^3$.

6. The composition of claim 1, wherein $R^3$ is methyl.

7. The composition of claim 1, wherein p is 3.

8. The composition of claim 1, wherein p and q are equal.

9. The composition of claim 1, wherein one or amines comprises an amine having a structure:

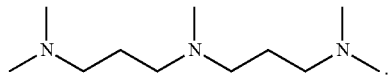

10. The composition of claim 1, wherein one or amines comprises an amine having a structure:

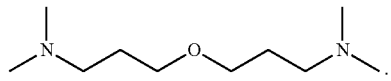

11. The composition of claim 1, wherein the composition comprises one or more amines according to Formula (II):

$$R^1{}_2N\text{-}(CH_2)_p—X\text{-}(CH_2)_p—NR^1{}_2$$ Formula (II)

and one or more acid phosphates capable of forming a salt with an amine according to Formula II, wherein X is selected from 0 and $NR^3$, p is an integer from 1 to 5, $R^1$ is linear or branched $C_{1-4}$ alkyl, hydroalkyl or alkoxyalkyl, $R^3$ is hydrogen, linear, or branched $C_{1-4}$ alkyl, hydroxyalkyl or alkoxyalkyl, or two $R^1$ moieties together form a cyclic morpholino group.

12. The composition of claim 1, wherein the composition comprises one or more amines according to Formula (I)

Formula (I)

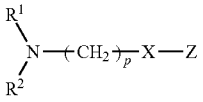

and one or more acid phosphates according to Formula (III),

Formula (III)

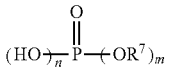

wherein $R^7$ is linear or branched (poly)oxyalkylene having a molecular weight in the range from 45 to 800, n being 1 or 2, m being 1 or 2, and n+m being 3.

13. The composition of claim 11, wherein the composition comprises one or more amines according to Formula (II)

$$R^1{}_2N\text{-}(CH_2)_p\text{—}X\text{-}(CH_2)_p\text{—}NR^1{}_2$$ Formula (II)

and one or more acid phosphates according to Formula (III),

Formula (III)

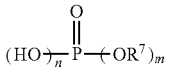

wherein $R^7$ is linear or branched (poly)oxyalkylene having a molecular weight in the range from 45 to 800, n being 1 or 2, m being 1 or 2, and n+m being 3, X is selected from 0 and $NR^3$, p is an integer from 1 to 5, $R^1$ is linear or branched $C_{1-4}$ alkyl, hydroalkyl or alkoxyalkyl, $R^3$ is hydrogen, linear, or branched $C_{1-4}$ alkyl, hydroxyalkyl or alkoxyalkyl, or two $R^1$ moieties together form a cyclic morpholino group.

14. The composition of claim 12, wherein the composition comprises a phosphate amine salt or mixture of phosphate amine salts according to Formula (IV), Formula (IV)

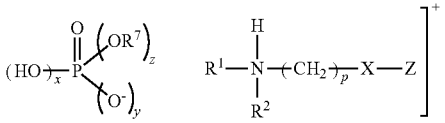

obtainable by combining one or more acid phosphates according to Formula (III) and one or more amines according to Formula (I), wherein x is 0 or 1, y is 1 or 2, z is 1 or 2, and x+y+z is 3.

15. The composition of claim 13, wherein the composition comprises a phosphate amine salt or mixture of phosphate amine salts according to Formula (V), Formula (V)

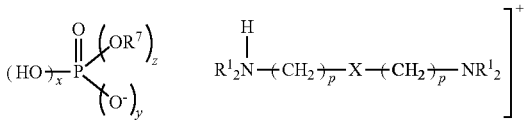

obtainable by combining one or more acid phosphates according to Formula (III) and one or more amines according to formula (II), wherein x is 0 or 1, y is 1 or 2, z is 1 or 2, and x+y+z is 3.

16. The composition of claim 12, wherein in the phosphate of Formula (III), $R^7$ is represented by the following Formula (VI):

Formula (VI)

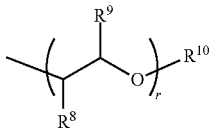

wherein $R^8$ and $R^9$ are independently hydrogen or $C_{1-4}$ alkyl, $R^{10}$ is $C_{1-36}$ linear, or branched alkyl, cycloalkyl, alkenyl, cycloalkenyl, aryl or aralkyl, and r is an integer from 1 to 10.

17. The composition of claim 13, wherein in the phosphate of Formula (III), $R^7$ is represented by the following Formula (VI):

Formula (VI)

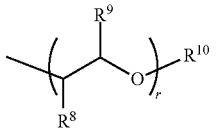

wherein $R^8$ and $R^9$ are independently hydrogen or $C_{1-4}$ alkyl, $R^{10}$ is $C_{1-36}$ linear, or branched alkyl, cycloalkyl, alkenyl, cycloalkenyl, aryl or aralkyl, and r is an integer from 1 to 10.

18. The composition of claim 1, wherein the acid phosphate comprises octyl decyl 4EO phosphate.

19. The composition of claim 1, wherein the phosphate has been salted with the amine and salting results in a mixture comprising, on a relative weight basis, 50% to 90% of the amine salt and 50% to 10% of the unreacted free amine.

20. A composition comprising an amine having Formula (IX)

Formula (IX)

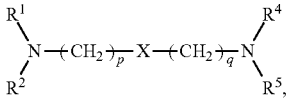

and one or more acid phosphates capable of forming a salt with an amine according to Formula (IX), wherein X is selected from 0 and $NR^3$, p is an integer from 1 to 5, q is an integer from 1 to 5, each of $R^1$ and $R^2$, independently is linear or branched $C_{1-4}$ alkyl, hydroalkyl or alkoxyalkyl; $R^3$ is a linear or branched $C_1$, $C_2$ or $C_3$ alkyl; $R^4$ and $R^5$ are independently selected from hydrogen, linear, or branched $C_{1-4}$ alkyl, hydroxyalkyl or alkoxyalkyl, or $R^1$ and $R^2$ and/or $R^4$ and $R^5$ together form a cyclic morpholino group.

* * * * *